US005651401A

United States Patent [19]

Cados

[11] Patent Number: 5,651,401

[45] Date of Patent: Jul. 29, 1997

[54] APPARATUS FOR FILLING RECEPTACLES

[75] Inventor: Dimitri Cados, Orinda, Calif.

[73] Assignee: Sahara Natural Foods, Inc., San Leandro, Calif.

[21] Appl. No.: 490,195

[22] Filed: Jun. 14, 1995

[51] Int. Cl.[6] ..... B65B 43/42; B67C 3/00

[52] U.S. Cl. ..... 141/129; 141/99; 141/103; 141/163; 141/175; 141/186; 141/241; 222/361

[58] Field of Search ..... 141/18, 99–105, 141/129, 156, 163, 178, 175, 183, 186, 188, 234, 241, 107; 222/361

[56] References Cited

U.S. PATENT DOCUMENTS

| | | | |
|---|---|---|---|
| 1,605,832 | 11/1926 | Garhart | 222/361 |
| 2,405,507 | 8/1946 | Lefren | 222/361 |
| 3,762,451 | 10/1973 | Anderson | 141/186 |
| 3,786,844 | 1/1974 | Smearsoll et al. | 141/8 |
| 3,987,824 | 10/1976 | Zehnder | 141/99 |
| 4,072,251 | 2/1978 | Huang | 222/333 |
| 4,101,284 | 7/1978 | Difiglio et al. | 23/259 |
| 4,585,040 | 4/1986 | Cramer | 141/137 |
| 4,733,680 | 3/1988 | Mosler | 141/31 |
| 4,733,803 | 3/1988 | Sisson et al. | 222/361 |
| 4,771,912 | 9/1988 | van Wingerden | 221/75 |
| 4,913,202 | 4/1990 | Miller et al. | 141/258 |
| 5,143,126 | 9/1992 | Boesch et al. | 141/1 |

*Primary Examiner*—Henry J. Recla
*Assistant Examiner*—Timothy L. Maust
*Attorney, Agent, or Firm*—Bielen, Peterson & Lampe

[57] ABSTRACT

An apparatus for filling multiple receptacles with foodstuffs utilizing a tray having at least first and second apertures through the same. The first and second apertures each possess an entrance and an exit and a chamber within the tray body of a pre-determined volume. Each aperture is spaced from one another on the tray. A feed conduit is also utilized to transport foodstuffs from any one of multiple containers to the tray. The tray is reciprocated to permit alternate communication between the feed conduit and the entrances to the first and second apertures. A cover closes the exits of any one of the apertures at the same time the aperture chamber is being filled with a foodstuff. In addition, reciprocation of the tray removes the cover and permits the foodstuff to pass to a conduit which leads the foodstuff to a container.

15 Claims, 4 Drawing Sheets

APPARATUS FOR FILLING RECEPTACLES

BACKGROUND OF THE INVENTION

The present invention relates to a novel apparatus for filling multiple receptacles with foodstuffs which may flow from multiple source containers.

The filling of receptacles with foodstuffs is a technology which is very important in the field of comestible products. This filling process is often complicated by mixing various products in different ratios prior to sealing the package.

In the past, many systems have been devised to fill or dispense liquid and particulate matter, such as foodstuffs, into containers. For example, U.S. Pat. No. 3,786,844 depicts a method of filling containers with friable particles by adjusting the size of the aperture through which the particles flow in response to an average weight determination of prior filled containers.

U.S. Pat. No. 4,585,040 describes a dispensing apparatus for uncompacted rice by the movement of a train of plates utilizing an auger. The hopper is caused to swing back and forth in a speed commensurate with an underlying plate to effect delivery of the rice to the container.

U.S. Pat. No. 4,913,202 shows a packaging for filling containers which employs a plug valve with a rotatable valve feed that controls flow through the valve chamber and into the container.

U.S. Pat. No. 4,072,251 depicts an automatic seed singulating and dispensing apparatus which employs three plates. Agitated feeds are forced into the vacant seed openings within a plate for the purpose of filling.

U.S. Pat. No. 3,987,824 describes a water glass filler that is slidably movable on a plate to selectively block or unblock openings in the plate. When unblocked, the ice cubes are passed into underlying glasses.

U.S. Pat. No. 4,101,284 illustrates a bead dispenser which employs movable plates that either stop or permit the flow of beads into containers.

U.S. Pat. No. 4,733,680 shows a dispenser which employs plates that are selectively aligned with each other to permit the flow of liquid into a receptacle. A vacuum release valve allows manual control of the fluid flow by the user.

U.S. Pat. No. 4,771,912 teaches a method for depositing seeds in packages which employ four plates that are movable relative to one another during a certain period of time in the cycle. A rod, which normally prevents movement of the plates, is removed to permit alignment of the plates and allow the seeds to flow into packages.

U.S. Pat. No. 3,762,451 shows an apparatus for filling moving containers that employs a pair of plates that are moved relative to one another by many dispensing heads. The openings through the plates are aligned at certain times during the process to meter the amount of flow of the matter into the containers. The timing of the openings being aligned with one another, thus, determines the amount of particulate matter being dispensed.

A receptacle filling apparatus which meters the amount of various components into a single receptacle would be a notable advance in the food distribution field.

SUMMARY OF THE INVENTION

In accordance with the present invention a novel and useful apparatus for filling multiple receptacles with foodstuffs is herein provided.

The invention includes as one of its element a tray having at least a first and a second aperture therethrough. Each of the first and second apertures possess an entrance and an exit between a central chamber of a pre-determined volume. The first and second apertures are spaced from one another on the tray. Moreover, the first and second apertures may form part of a set of apertures in a block, any one of which is removable from the tray. Such blocks placed in the tray may also include apertures of different sizes and, thus, volumes commensurate with the particular foodstuff to be eventually mixed into the receptacle. A bottom plate of the tray also includes apertures which align with the apertures in the removable blocks.

Further, feed conduits are connected to any one of a multiplicity of containers holding foodstuffs. In any particular block, first and second apertures may be formed to communicate with one feed conduit which slides along the top surface of any particular block in the tray and communicates with either the first or second aperture. It should be noted that means for urging the tray into cyclical movement permits such communication. The cyclical movement may be a reciprocal movement.

A cover is formed beneath the tray and is stationary relative to the reciprocating tray. The cover alternately closes the exits of the first and second apertures to permit filling of the same with a foodstuff. The closing of the exits of the first and second apertures is coordinated with the communication of the entrances of the first and second apertures, respectively with the feed conduit. The cover is open to the exit of the first or second aperture to permit the release of the foodstuff downwardly. Such release coincides with the feed conduit being in communication with the other of the first and second apertures. That is to say by way of example, when the cover opens the exit to release a foodstuff from the first aperture, the cover then moves into a closing position with respect to the second aperture, permitting filling of the second aperture with foodstuff from the feed conduit.

Means is also provided for conducting the foodstuff released from the first and second apertures to a receptacle. Such means may take the form of a funnel or any other conducting structure. This is especially applicable where a second conduit is employed with an adjacent second apertured block in the reciprocating tray. Thus, the funnel may serve to mix various components of the foodstuff before in the receptacle. Moreover, the volume sizing of any of the apertures automatically adjusts the amount of foodstuff which ultimately will be found in the receptacle.

It may be apparent that a novel and useful apparatus for filling multiple receptacles with foodstuff for multiple containers has been described herein.

It is therefore an object of the present invention to provide an apparatus for filling multiple receptacles with foodstuffs that employs a reciprocating tray combined with a stationary cover to operate such that one aperture of the reciprocating tray holding foodstuff is emptied immediately followed by the filling of another aperture.

Another object of the present invention is to provide an apparatus for filling multiple receptacles with foodstuffs that employs a reciprocating tray having removable blocks possessing a series of apertures to permit adjustment in the amount of a particular foodstuff eventually conducted to the receptacle.

A further object of the present invention is to provide an apparatus for filling multiple receptacles with foodstuffs that is versatile in mixing food combinations which may be adjusted according to a production schedule.

Another object of the present invention is to provide an apparatus for forming multiple receptacles with foodstuffs that is easily adaptable to assembly line packaging.

Yet another object of the present invention is to provide an apparatus for filling multiple receptacles with foodstuffs that provides for simple determination of volumetric quantities of a particular foodstuff being mixed in either receptacle being packaged.

A further object of the present invention is to provide an apparatus for filling multiple receptacles with foodstuffs that eliminates the need for weighing of an amount of foodstuff placed in the receptacle being packaged.

The invention possesses other object and advantages especially as concerns particular characteristics and features thereof which will be apparent as the specification continues.

The invention possesses other objects and advantages especially as concerns particular characteristics and features thereof which will become apparent as the specification continues.

DETAILED DESCRIPTION OF THE PREFERRED EMBODIMENTS

Various aspects of the present invention will evolve from the following detailed description of the preferred embodiments thereof which should be taken in conjunction with the heretofore described drawings.

Figure 4:
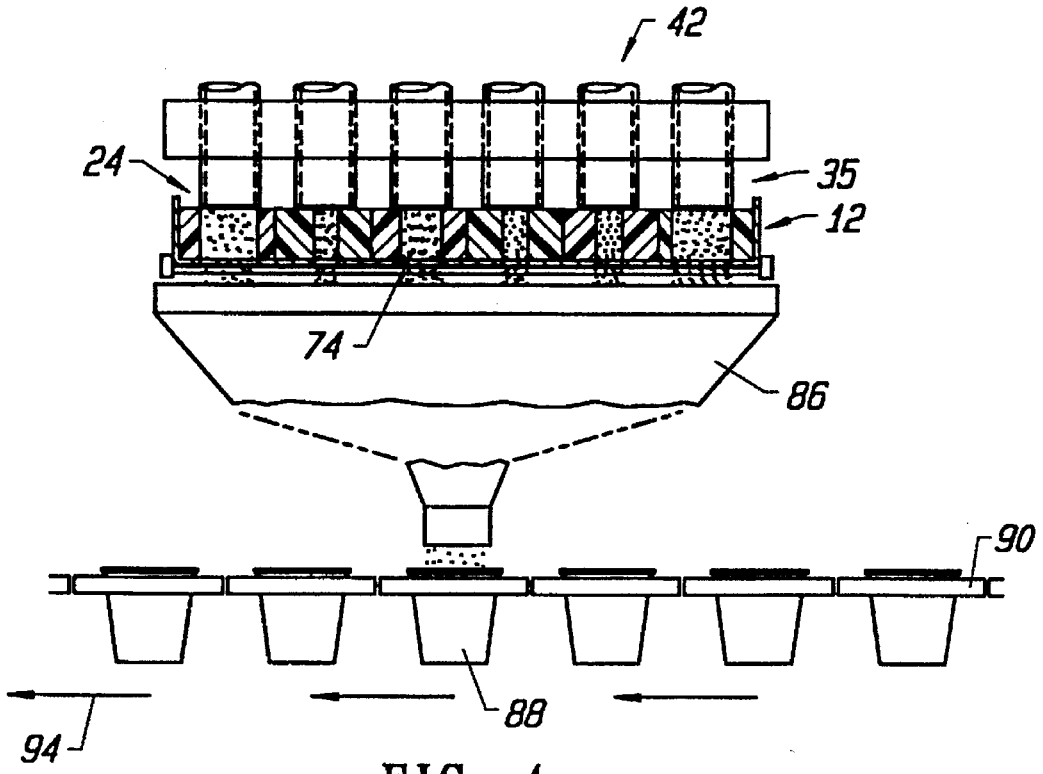
FIG. 4 is a sectional view taken along line 4—4 of FIG. 1 with the lower funnel and receptacle conveyor depicted in whole with a broken away portion.
Figure 5:
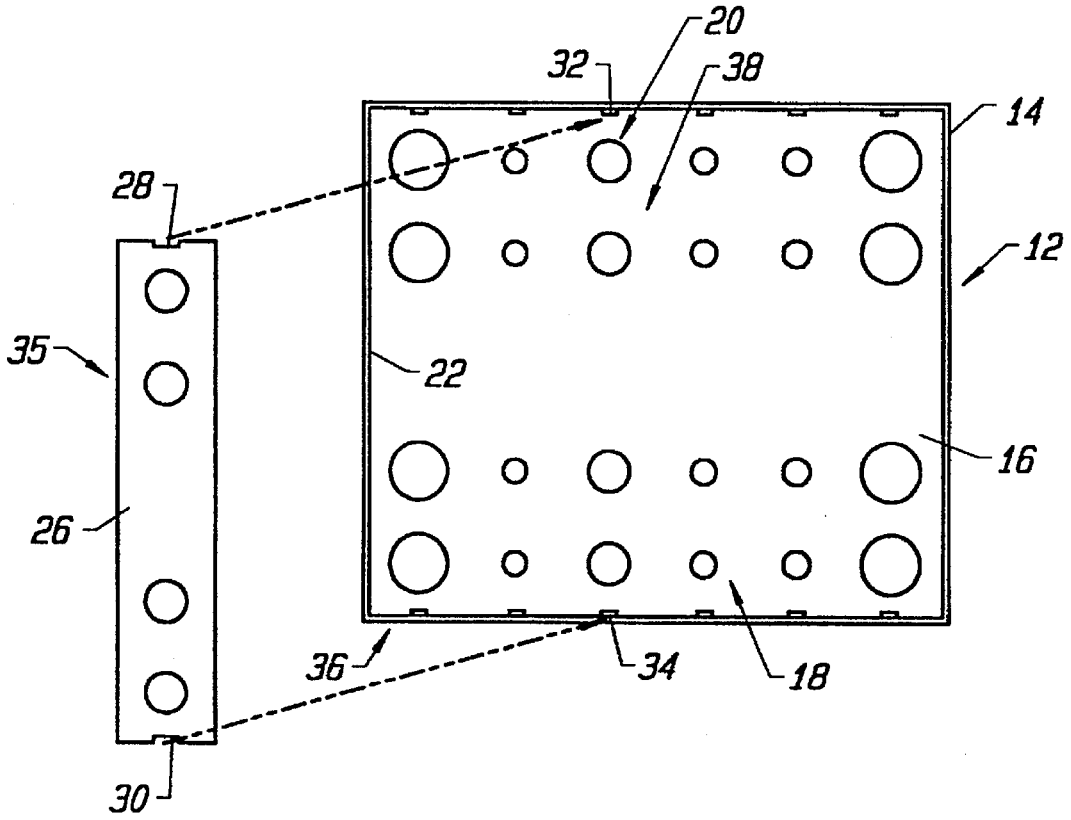
FIG. 5 is a top plan view of the tray of the present invention with a block having apertures exploded therefrom.

The invention as a whole is depicted in the drawings by reference character 10. Apparatus 10 includes as one of its elements a tray 12 which is generally rectangular in configuration. Tray 12 includes a side portion 14 which extends completely around tray 12. With reference to FIG. 5 it may also be observed that tray 12 includes a bottom plate 16 having a plurality of apertures 18 therethrough. In certain cases, apertures 18 may take the form of a grate of other supporting structures. Guides 20 extend along the inner surface 22 of side portion 14 of tray 12. Returning to FIG. 1, it may be seen that a plurality of blocks 24, depicted in FIG. 4, fit within tray 12. Returning again to FIG. 5, it may be observed that a block 26 is shown and includes end notches 28 and 30 which slide down guides 32 and 34 of plurality of guides 20. Block 26 is exemplary of much of the plurality of blocks 24. It should be noted that plurality of blocks 24 include multiplicity of apertures 36 which are sized and positioned to coincide with apertures 18 through plate 16. Specifically, plurality of apertures 35 of block 26, coincide with row of apertures 38 of plate 16.

Plurality of containers 40 each contain particular foodstuff, i.e., dried rice, peas, corn, tomatoes, bell peppers, carrots, spices, and the like. Containers are easily filled through the open tops and are funneled through flexible tubes which constitute a plurality of feed conduits 42, which extend downwardly through stationary supports 44 and 46. Multiple containers 40 and supports 44 and 46 are supported by a structure 48 of conventional configuration, depicted in phantom on FIG. 1.

Tray 12 lies atop two metallic strips 50 and 52 which may be deemed aperture covers, as will be explained hereinafter. Covers 50 and 52 slidingly engage bottom 54 of tray 12. Means 56 urges tray 12 into a cyclical movement, a reciprocal movement as shown by directional arrow 58 on FIG. 1. Brackets 60 holds an axle pin 62 which receives a force from push rod 64. Rotating shaft 66 turns arm 68, which in turn moves pivotally connected rod 64 back and forth according to directional arrows 70 and 72, FIGS. 2 and 3. Shaft 66 may be rotated by any conventional motor (not shown). Of course, other mechanical expedients may be utilized to move rod 64 and, thus, tray 12, back and forth according to directional arrow 58.

Figure 2:
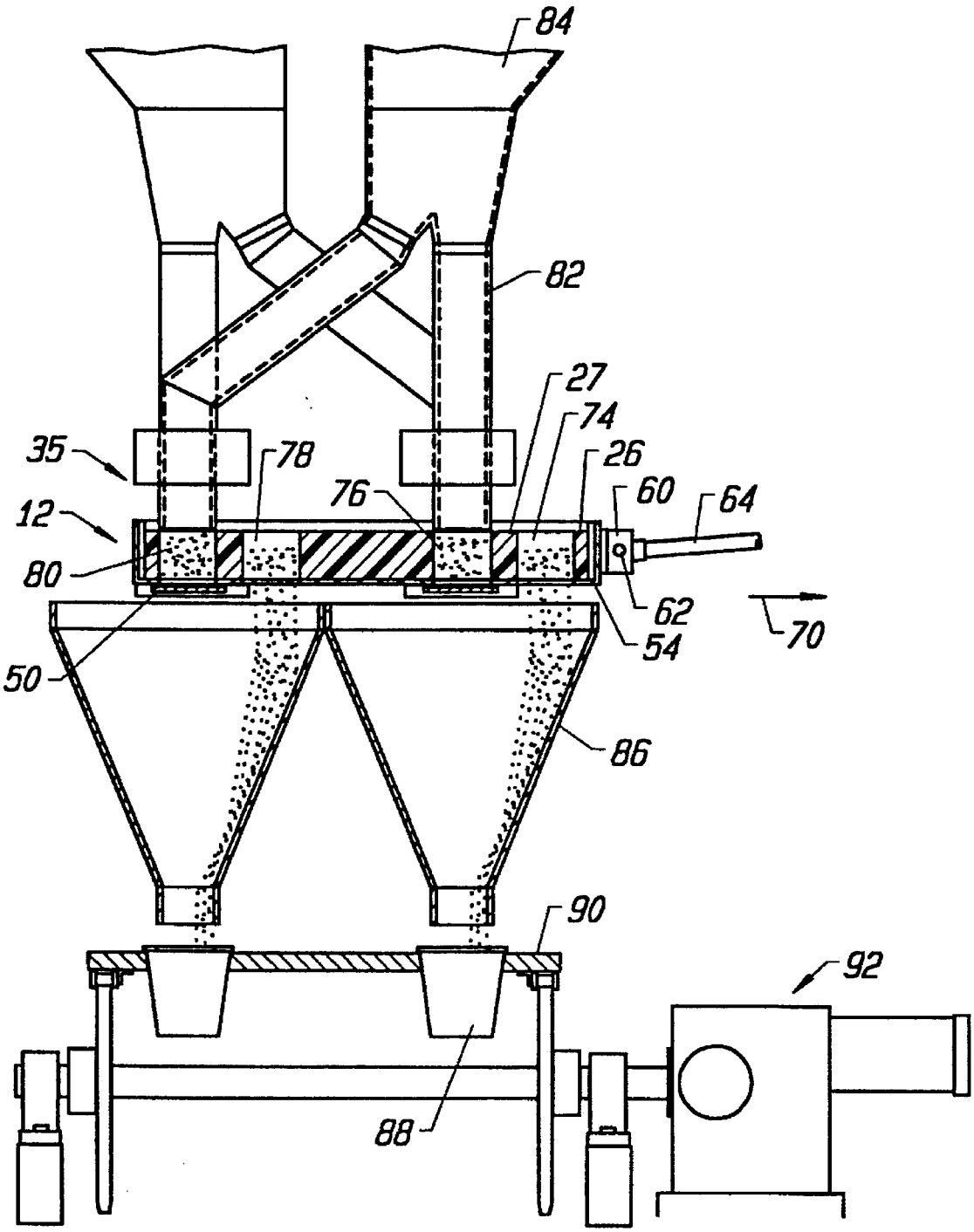
FIG. 2 is a sectional view taken along line 2—2 of FIG. 1.
Figure 3:
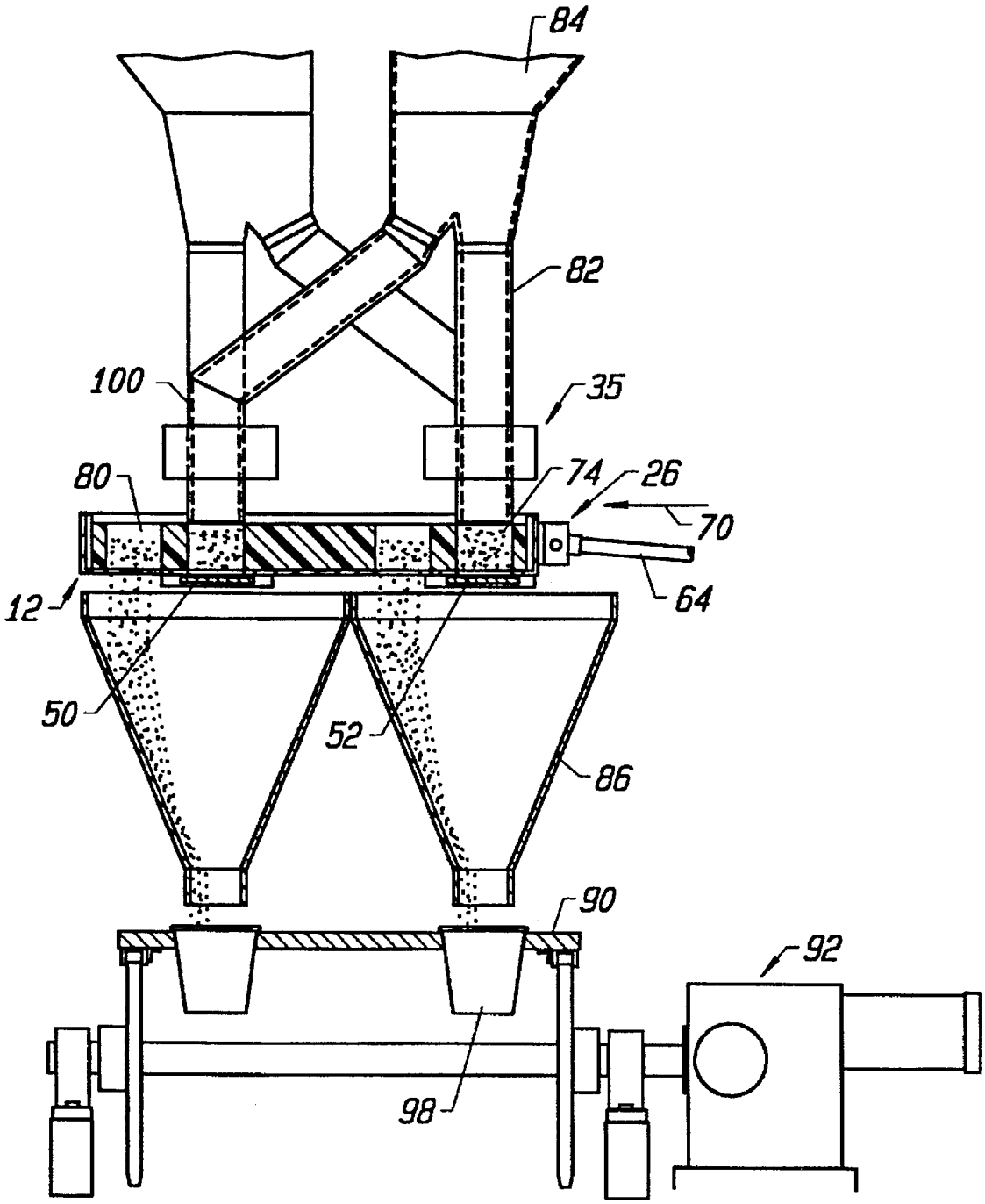
FIG. 3 is an identical sectional view to FIG. 2 except that the tray is depicted as being reciprocated half of a cycle.

Turning to FIGS. 2 and 3, it should be apparent that block 26 is shown to include apertures 74, 76, 78, and 80. Each of these apertures extends completely through block 26 defining a chamber or volume by the size of the bore. Each aperture 74, 76, 78, and 80 has an entrance at surface 27, and an exit at bottom surface 29, of tray 12. Focusing on apertures 74 and 76, a feed conduit 82 extends from container 84 which contains a particular foodstuff. Food is alternately filled and released from apertures 74 and 76 into means 86 for conducting foodstuffs to receptacle 88 shown as a cup within conveyor 90. Means 86, as depicted in the drawings, is funnel shaped which is ideal for mixing foodstuffs released from plurality of blocks 24. The specific operation of the filling and release of the foodstuffs from apertures 74 and 76 will be described in greater detail hereinafter.

Figure 1:
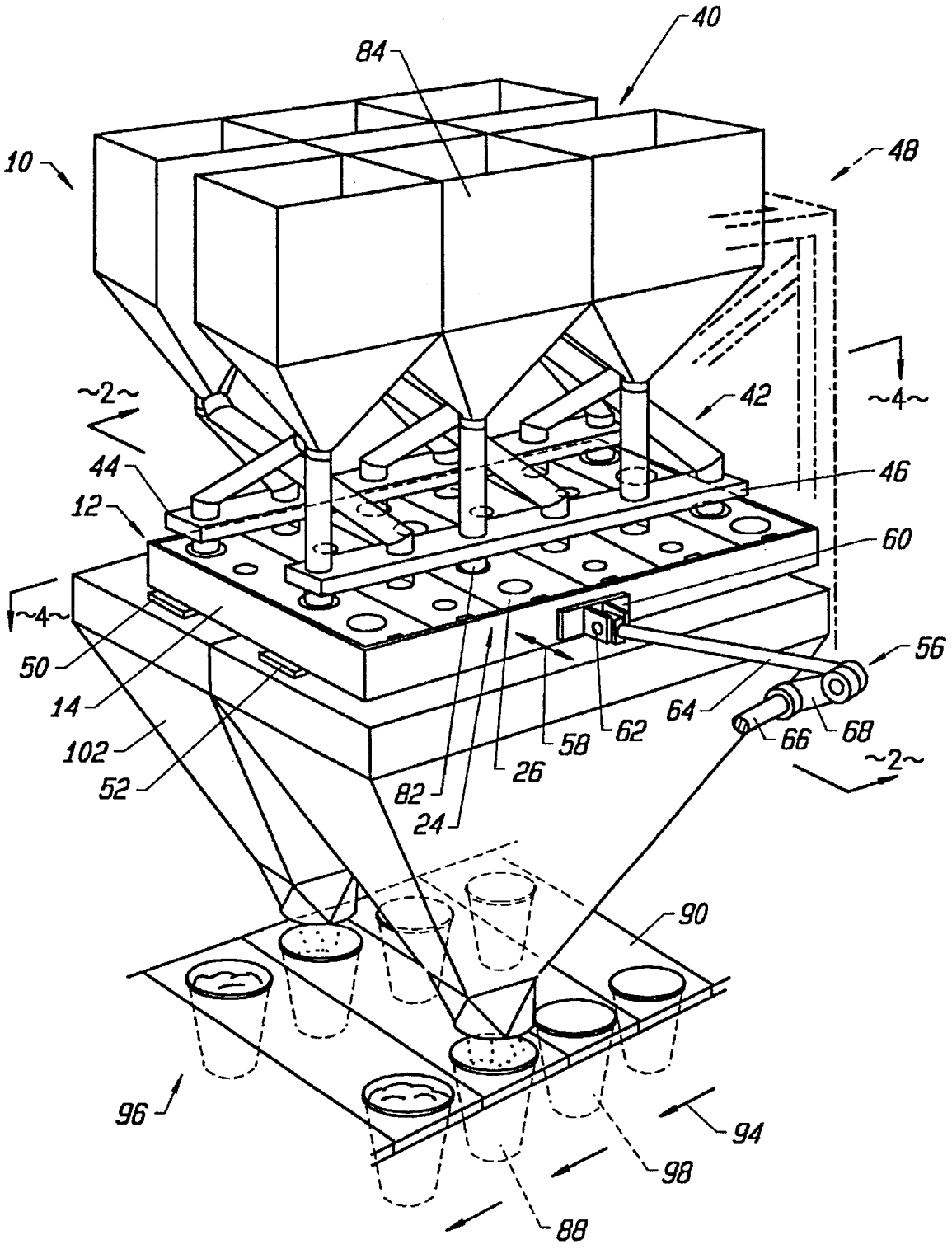
FIG. 1 is a top right perspective view of the apparatus of the present invention.

It should be apparent that the conveyor mechanism 92, movement, directional arrow 94, FIG. 1, may be timed to coincide with the release of foodstuffs from plurality of blocks 24 of tray 12. With reference to FIG. 4, it should be apparent that the multiplicity of apertures 36 may be of various sizes and volumes to pre-determine the eventual mix of material which passes through funnel 86 to receptacle 88. Plurality of conduits 42, of course, lead particular foodstuffs from multiple containers 84, as has been discussed hereinbefore. Receptacle 88 is eventually sealed and shipped for use. Of course, plurality of receptacles 96 are filled in a similar manner.

In operation, FIGS. 2 and 3, tray 12 is loaded with particular apertures blocks 24. Plurality of apertures 36 align with plurality of apertures 18 of plate 16. With specific reference to apertures 74 and 76 of block 26, plurality of apertures 35, FIG. 2, tray 12 is moved to the right in FIG. 2 permitting communication between conduit 82 and aperture 76. Conduit 82 slidingly engages the upper surface 27 of block 26 of tray 12 around and between apertures 74 and 76. Foodstuffs are only released when aperture 76 is positioned beneath the open end of conduit 82. Foodstuffs fill aperture 76 but are prevented from passing downwardly into funnel 86 by cover 52. Aperture 74 previously filled is emptied into funnel 86 at this point. In viewing FIG. 3, it should be seen that tray 12 is then pushed to the left in FIG. 3 such that empty aperture 74 is now in communication with conduit 82. Cover 52 now closes the exit from aperture 74 to prevent foodstuffs from entering funnel 86. At this time, the foodstuffs within aperture 76 are free to fall into funnel 86 and into the next succeeding receptacle 98. That is to say, plurality of receptacles 96 are timed in a conventional manner to advance to the next succeeding receptacle each time tray 12 reciprocates as shown in FIGS. 2 and 3. With reference to FIG. 4, it may be observed that not only are the contents of aperture 74 emptied into funnel 84, but adjacent apertures from plurality of blocks 24 also empty into funnel 86 at this time, FIGS. 2 and 4, mixing foodstuffs into a pre-formulated combination. The identical operation is carried out with respect to apertures 78 and 80 of block 26 by the utilization of conduit 100 and cover 50. In other words, apertures 76 and 80 empty at the same time while apertures 74 and 78 fill at the same time, and visa versa. Moreover, each aperture of plurality of blocks 24 are filled and emptied into funnels 86 and 102 via conduits 42. Cover plates 50 and 52 extend along bottom of plate 16 of tray 12 to serve as a cover for all apertures of blocks 24 during the filling operation hereinbefore described.

While, in the foregoing, embodiments of the present invention have been set forth in considerable detail for the purposes of making a complete disclosure of the be apparent to those be apparent to those of skill in the art that numerous changes may be made in such details without departing from the spirit and principles of the invention.

What is claimed is:

1. An apparatus for filling multiple receptacles with foodstuffs from multiple containers;

comprising:

a. a tray having at least a first and second aperture therethrough, each of said first and second apertures possessing an entrance and an exit, said first and second apertures each possessing a chamber of a predetermined volume and being spaced from one another on said tray, said tray further comprising third and fourth apertures therethrough, adjacent said first and second apertures, each of said third and fourth apertures possessing a chamber of a predetermined volume and spaced from one another on said tray;

b. one feed conduit connected to one of said multiple containers, said one feed conduit terminating at said tray;

c. another feed conduit connected to another of said multiple containers, said another feed conduit terminating at said tray;

d. means for urging said tray into cyclical movement to permit communication between said one feed conduit and, alternately, to said entrances to said first and second apertures; said means for urging said tray into cyclical movement further permitting alternate communication between said another feed conduit and said entrances to said third and fourth apertures;

e. one cover for alternately closing said exits of said first and second apertures, to permit filling with a foodstuff when said entrances of said first and second apertures, respectively, are in communication with said feed conduit, and for alternately opening said exits of said first and second apertures to permit release of the foodstuff therein when said first and second apertures, respectively, are not in communication with said feed conduit, another cover for alternately closing said exits of said third and fourth apertures to permit filling with a foodstuff when said entrances of said third and fourth apertures, respectively, are in communication with said feed conduit, and alternately for opening said exits of said third and fourth apertures to permit release of the foodstuff, therein, when said third and fourth apertures, respectively, are not in communication with said another feed conduit; and f. means for conducting the food released from the first, second, third, and fourth apertures to a container.

2. The apparatus of claim 1 in which said means for conducting the foodstuff released from the first and second apertures to a container comprise a funnel.

3. The apparatus of claim 1 in which said means for urging said tray into cyclical movement further comprises means for urging said tray into a reciprocal movement.

4. The apparatus of claim 1 in which said cover is stationary relative to said tray.

5. The apparatus of claim 1 in which said feed conduit slidingly contacts said tray.

6. The apparatus of claim 1 in which said means for conducting the foodstuff from the first and second apertures and said means for conducting the foodstuff from the third and fourth apertures is a common conduit.

7. The apparatus of claim 6 in which said common conduit is a funnel.

8. The apparatus of claim 1 in which said one and another covers and formed as a unitary member slidingly engaging said tray.

9. The apparatus of claim 8 in which said means for urging said tray into cyclical movement further comprises means for urging said tray into a reciprocal movement.

10. The apparatus of claim 9 in said one and another covers are formed as a unitary member are stationary relative to said trays.

11. The apparatus of claim 10 in which said one and another feed conduits each slidingly engage said tray.

12. The apparatus of claim 1 in which said first and second apertures are formed into a block, said block being removably placed in said tray.

13. The apparatus of claim 12 in which said block is a first block and further includes a second block, said second block including at least one aperture therethrough, said first block being placed adjacent said second block, another feed conduit connected to one of said multiple containers and terminating at said tray, said means for urging said tray into cyclical movement further permit communication between said second feed conduit and said at least one aperture of said second block.

14. The apparatus of claim 13 in which said second block includes a second aperture therethrough and said means for urging said tray into cyclical movement further permits communication between said second feed conduit and alternately between said first and second apertures of said second block.

15. The apparatus of claim 14 in which said another feed conduit slidingly contacts said tray.

* * * * *